US008387232B2

(12) United States Patent
Hong et al.

(10) Patent No.: US 8,387,232 B2
(45) Date of Patent: Mar. 5, 2013

(54) METHOD OF MANUFACTURING ANTENNA FORMED WITH CASE

(75) Inventors: Ha Ryong Hong, Gyunggi-do (KR); Jae Suk Sung, Gyunggi-do (KR)

(73) Assignee: Samsung Electro-Mechanics Co., Ltd., Gyunggi-Do (KR)

( * ) Notice: Subject to any disclaimer, the term of this patent is extended or adjusted under 35 U.S.C. 154(b) by 0 days.

(21) Appl. No.: 13/345,907

(22) Filed: Jan. 9, 2012

(65) Prior Publication Data

US 2012/0104652 A1 May 3, 2012

Related U.S. Application Data

(62) Division of application No. 12/171,064, filed on Jul. 10, 2008, now Pat. No. 8,120,539.

(30) Foreign Application Priority Data

Jul. 11, 2007 (KR) ..... 10-2007-69566

(51) Int. Cl.
*H01P 11/00* (2006.01)
*H01Q 13/00* (2006.01)

(52) U.S. Cl. ..... 29/600; 343/702; 343/873

(58) Field of Classification Search ..... 29/600, 29/592.1, 830–832; 343/700 MS, 868
See application file for complete search history.

(56) References Cited

U.S. PATENT DOCUMENTS

| | | | | |
|---|---|---|---|---|
| 4,123,756 | A * | 10/1978 | Nagata et al. | 343/702 |
| 5,510,802 | A | 4/1996 | Tsuru et al. | |
| 6,356,245 | B2 | 3/2002 | Metzen et al. | |
| 6,396,444 | B1 * | 5/2002 | Goward et al. | 343/702 |
| 7,271,769 | B2 | 9/2007 | Asano et al. | |
| 7,391,378 | B2 | 6/2008 | Mikkola et al. | |
| 7,468,709 | B2 * | 12/2008 | Niemi et al. | 343/873 |
| 7,570,218 | B2 | 8/2009 | Tsujimura et al. | |
| 7,973,727 | B2 * | 7/2011 | An et al. | 343/702 |
| 8,068,067 | B2 * | 11/2011 | Hong et al. | 343/873 |
| 8,120,539 | B2 * | 2/2012 | Hong et al. | 343/702 |
| 2003/0189520 | A1 | 10/2003 | Goto et al. | |
| 2004/0041733 | A1 | 3/2004 | Milosavljevic | |
| 2005/0001767 | A1 | 1/2005 | Wulff et al. | |
| 2006/0170597 | A1 | 8/2006 | Kurashima et al. | |

FOREIGN PATENT DOCUMENTS

| | | |
|---|---|---|
| DE | 20050039586 | 2/2007 |
| EP | 1085597 | 3/2001 |
| EP | 1225652 | 7/2002 |
| EP | 1439601 | 7/2004 |
| EP | 1188534 | 8/2005 |

(Continued)

OTHER PUBLICATIONS

Japanese Office Action for Patent Application No. 2008-178387 mailed Nov. 24, 2010.

(Continued)

*Primary Examiner* — Minh Trinh
(74) *Attorney, Agent, or Firm* — Lowe Hauptman Ham & Berner, LLP

(57) ABSTRACT

There is provided an antenna integrally formed with a case and a method of manufacturing the same. An antenna integrally formed with a case according to an aspect of the invention includes: a case unit formed of a dielectric material; a radiator including a radiation unit tightly fixed to an outer surface of the case unit and terminal units each extending from an end portion of the radiation unit, passing through the case unit, and exposed on the inside of the case unit; and contact pins provided on a board disposed adjacent to the case unit and electrically connected to the individual terminal units.

11 Claims, 8 Drawing Sheets

FOREIGN PATENT DOCUMENTS

| | | |
|---|---|---|
| EP | 1667282 | 6/2006 |
| EP | 1686651 | 8/2006 |
| GB | 2380863 | 9/2003 |
| JP | 09321529 | 12/1997 |
| JP | 11177327 | 7/1999 |
| JP | 2000322545 | 11/2000 |
| JP | 2003078323 | 3/2003 |
| JP | 2003158415 | 5/2003 |
| JP | 2003234668 | 8/2003 |
| JP | 2005190064 | 7/2005 |
| JP | 2006067478 | 3/2006 |
| JP | 2006094521 | 4/2006 |
| JP | 2006129038 | 5/2006 |
| KR | 1020060011808 | 3/2006 |
| KR | 200688073 | 8/2006 |
| KR | 1020070023878 | 3/2007 |
| WO | 2005024996 | 3/2005 |
| WO | 2005034286 | 4/2005 |

OTHER PUBLICATIONS

German Office Action for Patent Application No. 10-2008-031-934.1, mailed Dec. 8, 2010.

Office Action for JP2008-178387 dated Jul. 13, 2010.

* cited by examiner

METHOD OF MANUFACTURING ANTENNA FORMED WITH CASE

CROSS-REFERENCE TO RELATED APPLICATIONS

This application is a divisional of prior U.S. application Ser. No. 12/171,064, filed Jul. 10, 2008, which is now U.S. Pat. No. 8,120,539, and claims the priority of Korean Patent Application No. 2007-0069566 filed on Jul. 11, 2007, in the Korean Intellectual Property Office, the disclosure of which is incorporated herein by reference.

BACKGROUND OF THE INVENTION

1. Field of the Invention

The present invention relates to an antenna formed with a case and a method of manufacturing the same, and more particularly, to an antenna formed with a case and a method of manufacturing the same that can reduce manufacturing costs by reducing the number of components.

2. Description of the Related Art

With the rapid development of wireless communication, wireless communication terminals, such as cellular phones and personal digital assistants (PDAs), have recently come into widespread use. Size reduction of the terminals has also proceeded rapidly. Further, a large number of portable electronic devices including laptop computers and other portable electronic devices having a wireless LAN connection have a wireless communication function.

Therefore, antennas used in the electronic devices have been reduced in size. In particular, an internal antenna that is provided within a device has been widely used.

Korean Patent Laid-Open Publication No. 10-2006-0011808 discloses an internal antenna provided within a cellular phone. Here, the antenna includes a base detachably fixed to a main body of the cellular phone, a support film integrally provided with the surface of the base, and an antenna pattern applied on the support film.

However, the internal antenna needs to be provided on the base that is a separate connection member detachably assembled to the main body, and the internal antenna on the base needs to be separately assembled to the main body, which increases the number of components and complicates an assembly process.

Further, since the antenna needs to be provided on the base having a relatively smaller size than the main body, a radiation area is expanded when designing the antenna, which limits radiation characteristics.

SUMMARY OF THE INVENTION

An aspect of the present invention provides an antenna integrally formed with a case and a method of manufacturing the same that can reduce manufacturing costs, increase deign flexibility of the antenna, and improve radiation characteristics.

According to an aspect of the present invention, there is provided an antenna integrally formed with a case, the antenna including: a case unit formed of a dielectric material; a radiator including a radiation unit tightly fixed to an outer surface of the case unit and terminal units each extending from an end portion of the radiation unit, passing through the case unit, and exposed on the inside of the case unit; and contact pins provided on a board disposed adjacent to the case unit and electrically connected to the individual terminal units.

The case unit may be any one of front and rear cases assembled with each other to form an internal space at which the board is disposed.

The radiator may further include a protection film having one surface at which patterns are printed by using a conductive material to form the radiation unit and the terminal units.

The radiation unit may be exposed to the outside through the protection film.

The terminal units may include at least on feed terminal tightly contacting an inner surface of the case unit and at least one ground terminal.

Each of the contact pins may be formed of an elastic member electrically connected to an RF circuit provided on the board and having one end elastically contacting the terminal unit.

According to an aspect of the present invention, there is provided a method of manufacturing an antenna integrally formed with a case, the method including: providing a radiator; fixing a fixing end of the radiator to a lower mold and disposing the radiator in a lower cavity of the lower mold; injecting a dielectric resin material into a cavity formed by assembling the lower mold and an upper mold with each other, and molding a case unit having the radiator integrally provided thereon; and separating the upper and lower molds from the case unit and cutting off the fixing end protruding outward from the case unit.

The providing a radiator may include forming conductive patterns on the surface of a protection film to form a radiation unit and terminal units.

The radiation unit may be exposed to the outside through the protection film.

The disposing the radiator may include fixing the fixing end of the radiator to any one of a plurality of position determining pins provided on the lower mold.

The fixing end may be a fixing hole into which the position determination pin is inserted.

In the molding a case unit, the radiation unit of the radiator tightly may contact an outer surface of the case unit and is exposed on the outside of the case unit, the terminal units each extending from one end portion of the radiation unit may be exposed on the inside of the case unit, and a part connecting the radiation unit and the terminal units to each other may be buried in the case unit.

The method may further include disposing the front case having the radiator integrally molded thereon to be adjacent to the board to contact the contact pins provided on the board and the terminal units of the radiator.

The contact pins may elastically contact the individual terminal units.

BRIEF DESCRIPTION OF THE DRAWINGS

The above and other aspects, features and other advantages of the present invention will be more clearly understood from the following detailed description taken in conjunction with the accompanying drawings, in which.

DETAILED DESCRIPTION OF THE PREFERRED EMBODIMENT

Exemplary embodiments of the present invention will now be described in detail with reference to the accompanying drawings.

Figure 1:
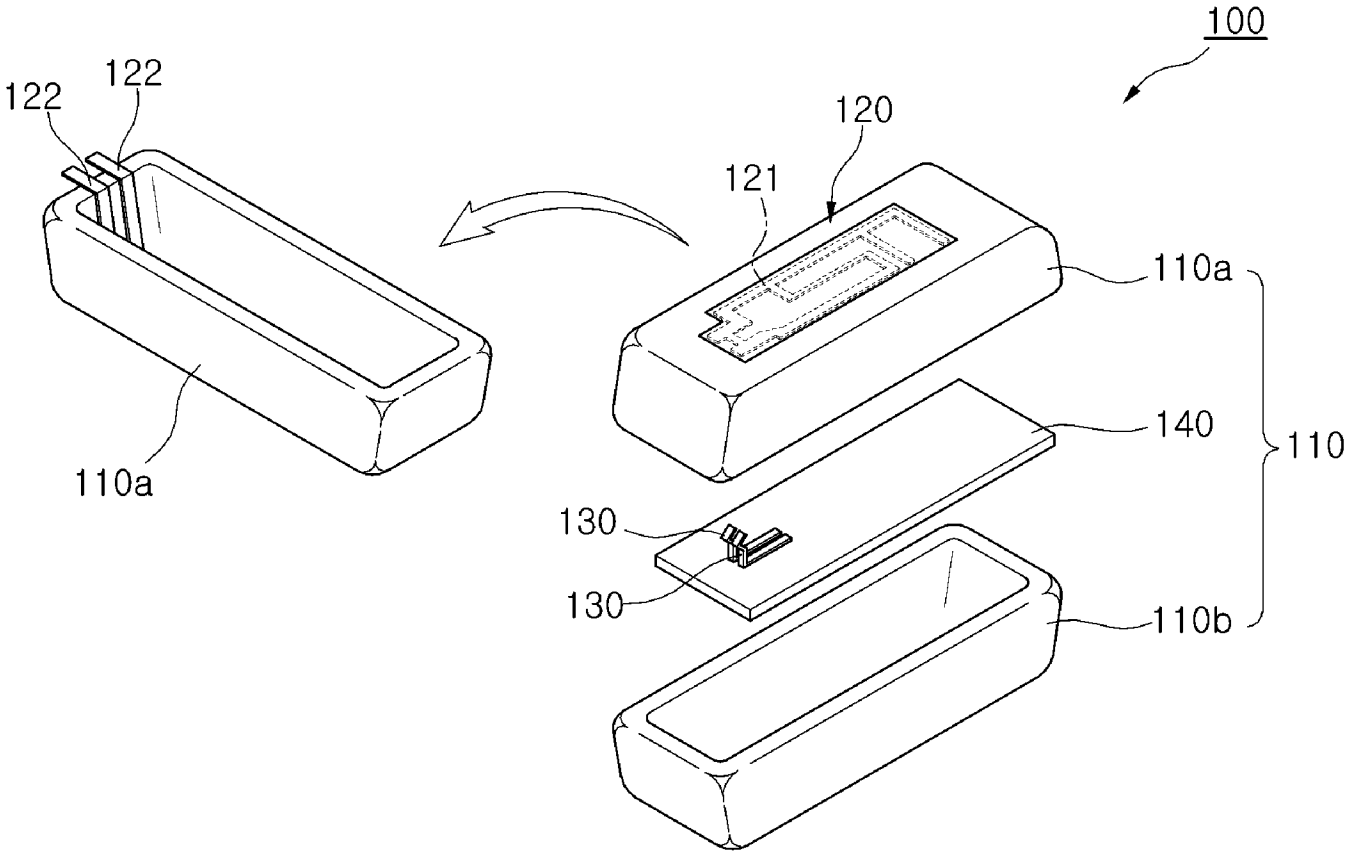
FIG. 1 is an exploded perspective view illustrating an antenna integrally formed with a case according to an exemplary embodiment of the present invention.
Figure 2:
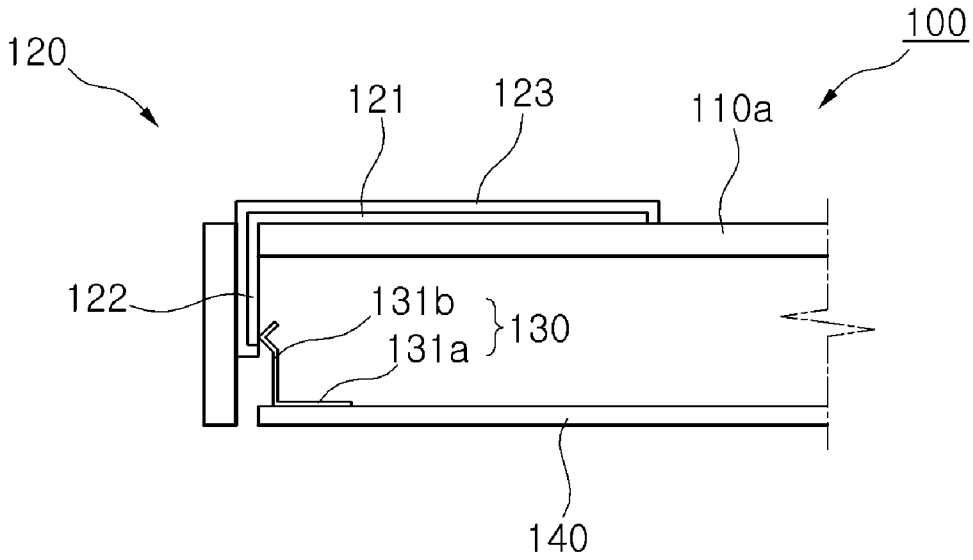
FIG. 2 is a longitudinal sectional view illustrating the antenna integrally formed with a case according to an exemplary embodiment of the present invention.
Figure 3:
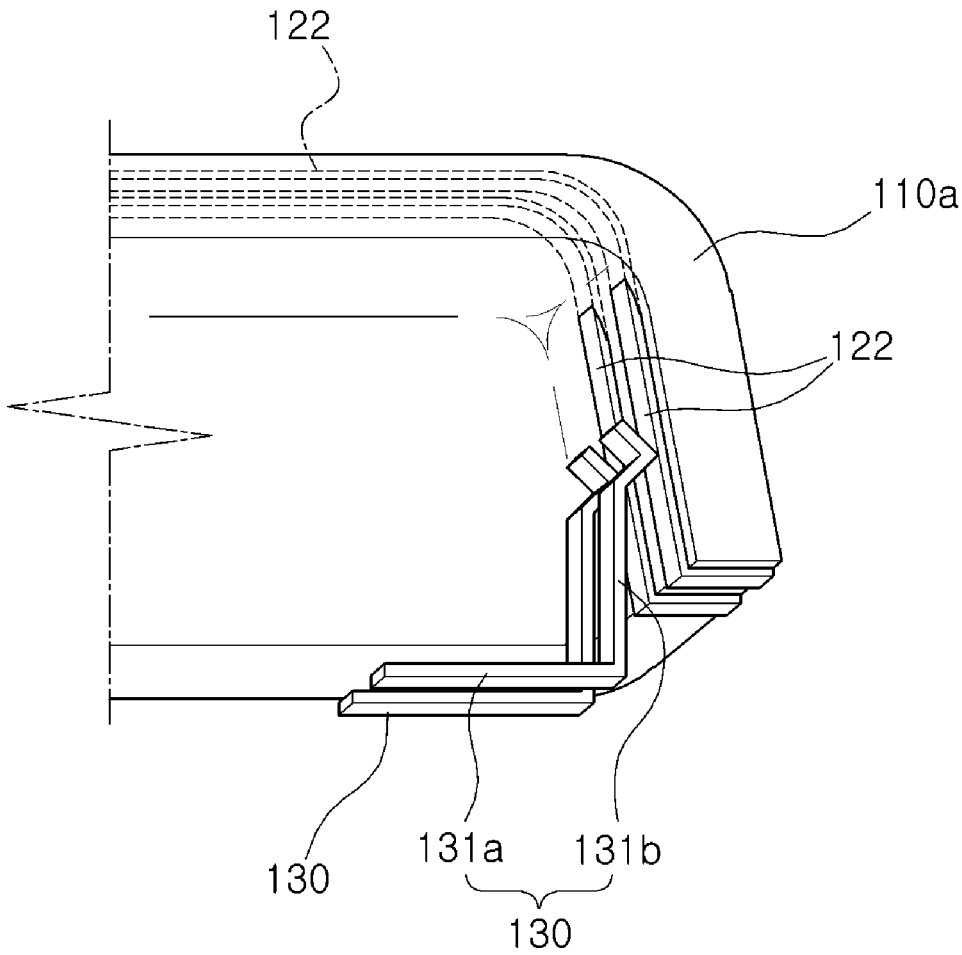
FIG. 3 is a detailed view illustrating contact between terminal units and contact pins in the antenna integrally formed with a case according to an exemplary embodiment of the present invention.
Figure 4:
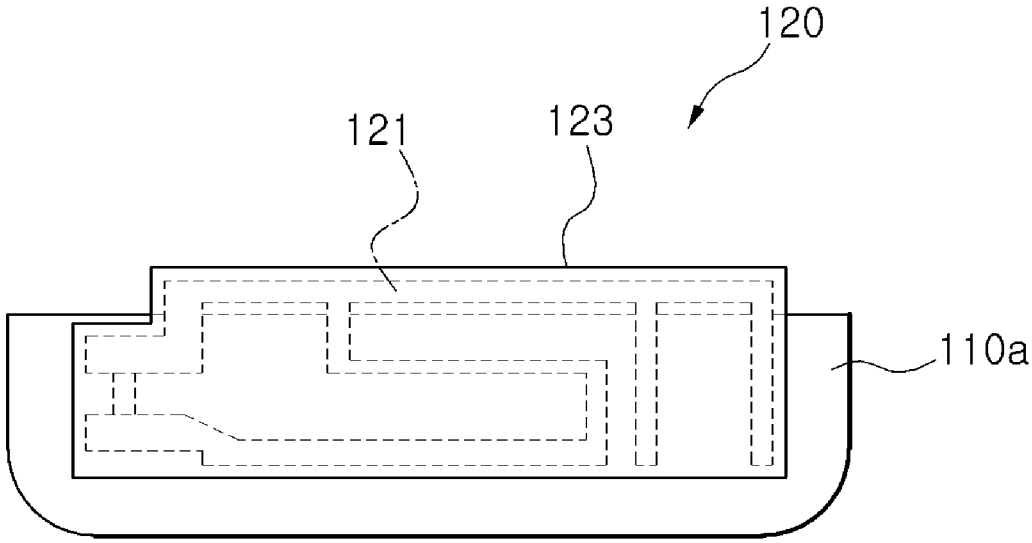
FIG. 4 is a plan view illustrating the antenna integrally formed with a case according to an exemplary embodiment of the present invention.

FIG. 1 is an exploded perspective view illustrating an antenna integrally formed with a case according to an exemplary embodiment of the present invention. FIG. 2 is a longitudinal sectional view illustrating the antenna integrally formed with a case according to the exemplary embodiment of the present invention. FIG. 3 is a detailed view illustrating contact between terminal units and contact pins of the antenna integrally formed with a case according to the exemplary embodiment of the present invention. FIG. 4 is a plan view illustrating the antenna integrally formed with a case according to an exemplary embodiment of the present invention.

As shown in FIGS. 1 to 4, an antenna 100 according to an exemplary embodiment of the invention includes a case unit 110, a radiator 120 integrally formed with the case unit 110, and contact pins 130*a* elastically contacting the radiator 120.

The case unit 110 is a structure that is molded by using a resin material formed of a dielectric substance.

The case unit 110 may be formed of a front case 110*a* and a rear case 110*b* that are assembled with each other so that the board 140 is disposed in an internal space between the front case 110*a* and the rear case 110*b*. A plurality of electronic components and an RF circuit (not shown) electrically connected to the contact pins 130 are mounted onto the board 140.

The radiator 120 includes a radiation unit 121, terminal units 122, and a protection film 123 and is integrally formed with the case unit 110. The radiation unit 121 and the terminal units 122 are formed of a conductive material that is printed or deposited in predetermined patterns on one surface of the protection film 123.

The radiator 120 including the radiation unit 121 and the terminal units 122 is formed of a conductive material, and performs physical input and output of signals by generating an induced current by electromagnetic waves or by generating electromagnetic waves by an electrical signal.

When the front case 110 that forms the case unit 110 is molded, the radiation unit 121 tightly contacts an outer surface of the front case 110*a*. Each of the terminal units 122 is one end portion that extends from of the radiation unit 121. When molding the front case 110*a*, each of the terminal units 122 passes through the front case 110*a* and is exposed on the inside of the front case 110*a*.

Further, the protection film 123 on which the radiation unit 121 is formed is exposed on the outside of the front case 110*a*, whereas the protection film 123 on which each of the terminal units 122 are formed tightly contacts to an inner surface of the front case 110*a*.

Here, when a signal used in the radiator 120 has a wavelength of $\lambda$, the radiation unit 121 preferably has an electrical length corresponding to $\lambda/4$, and a predetermined slit is formed in the radiation unit 121.

The slit changes the entire electrical length of the radiator 120 and generates electrical coupling in the radiator 120. By extending the bandwidth of the antenna or introducing an additional resonance frequency, a broadband or multiband antenna can be realized.

Preferably, the protection film 123 is formed of a transparent polymer material. More preferably, the protection film 123 is formed of any one of PET (Polyethylene Terephthalate), PP (Polypropylene), and PE (Polyethylene).

Further, each of the contact pins 130 is formed of a conductive elastic member that is electrically connected to an RF circuit (not shown) of the board 140 that is disposed adjacent to the front case 110*a* of the case unit 110.

When the front case 110*a* and the board 140 correspond to each other, a free end of each of the contact pins 130 elastically contacts the terminal unit 122 that is exposed on the inside of the front case 110*a*, such that the contact pins 130 are electrically connected to the individual terminal units 122.

Here, each of the contact pins 130 includes a fixed portion 131*a* that is fixed to the board 140 and a bent elastic portion 131*b* that extends from the fixed portion 131*a* and elastically contacts the terminal unit 122.

Each of the terminal units 122 connected to the contact pins 130 includes at least one ground terminal and at least one feed terminal extending from the radiation unit 121 and tightly contacts the inner surface of the front case 110*a*. The contact pins 130 are individually connected to the feed terminal and the ground terminal.

Here, the drawings are given and the description has been made of a case in which the radiator 120 is provided on the front case 110*a* forming the case unit 110. However, the present invention is limited thereto. The radiator 120 may be applied to the rear case 110*b* that is assembled with the corresponding front case 110*a* or to a molded structure independently assembled with the upper surface of the board 140.

FIGS. 5A, 5B, 5C, and 5D are views illustrating a process of illustrating an antenna integrally formed with a case according to another exemplary embodiment of the present invention.

Figure 5A:
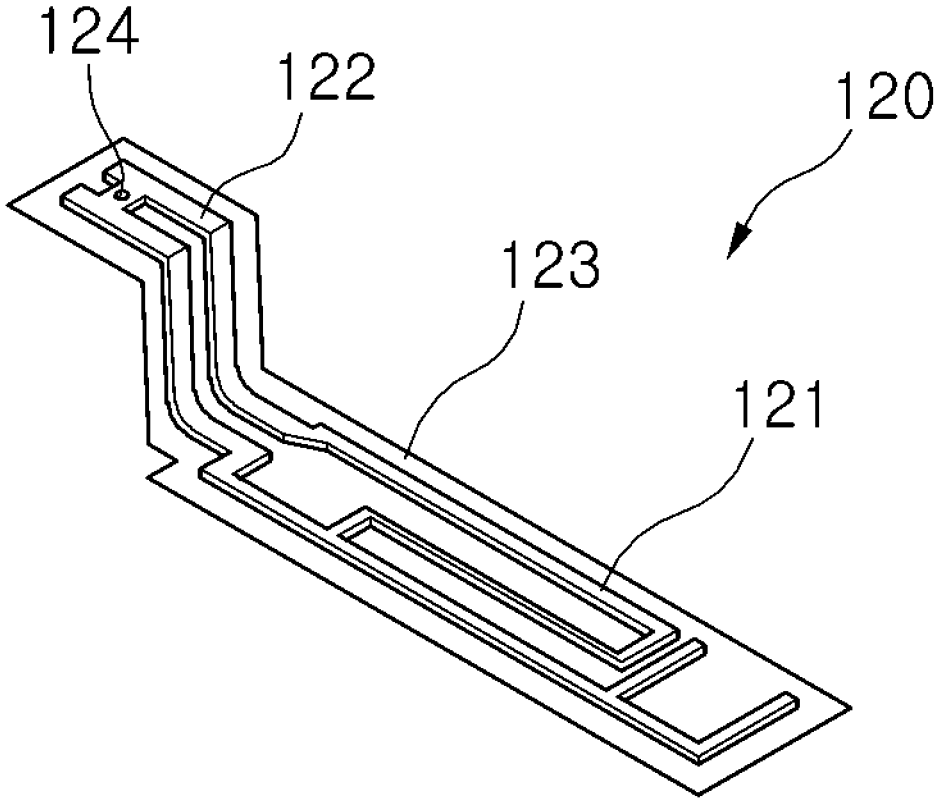
FIGS. 5A, 5B, 5C, and 5D are views sequentially illustrating a process of manufacturing an antenna integrally formed with a case according to another exemplary embodiment of the present invention.

As shown in FIG. 5A, a radiator 120 that has a radiation unit 121 and terminal units 122 formed on an outer surface of a transparent protection film 123 is provided.

The radiation unit 121 and the terminal units 122 are conductive patterns that are printed on the outer surface of the protection film 123 according to predetermined patterns.

Figure 5B:
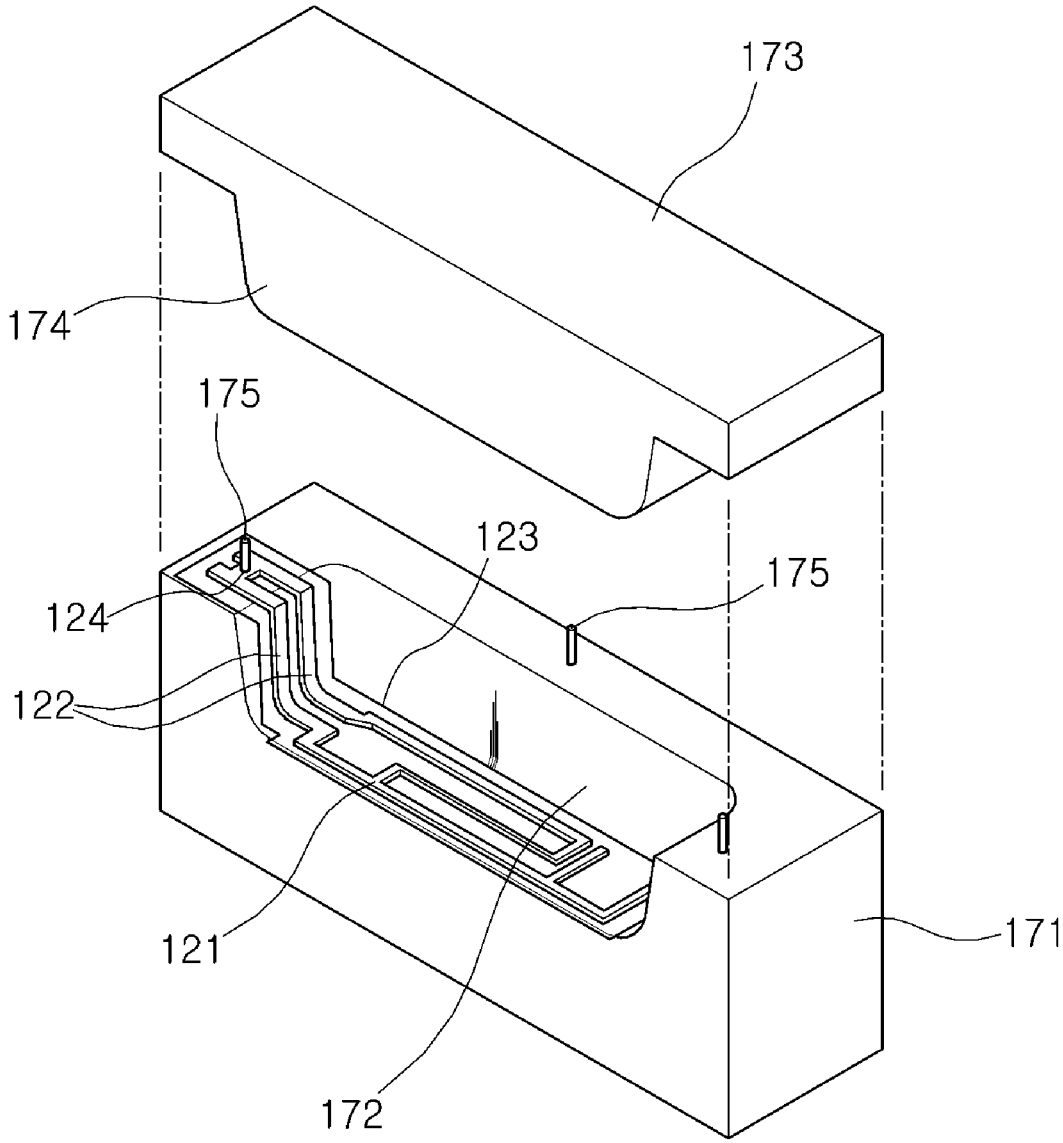

Then, as shown in FIG. 5B, the radiator 120 is disposed in a lower cavity 172 of a lower mold 171.

Here, a fixing end 124 extending from one end of the radiator 120 is caught and fixed by any one of a plurality of position determining pins 175 formed on the lower mold 171. When the lower mold 171 and the upper mold 173 are molded with each other, the position determining pins 175 are inserted into and coupled with position determination holes (not shown) formed in the upper mold 173.

Preferably, the fixing end 124 is formed in the shape of a fixing hole into which the position determining pin 175 is inserted.

The fixing end 124 fixed by the position determining pin 175 enables the radiator 120 to firmly maintain its initial position even when a resin material is injected.

Figure 5C:
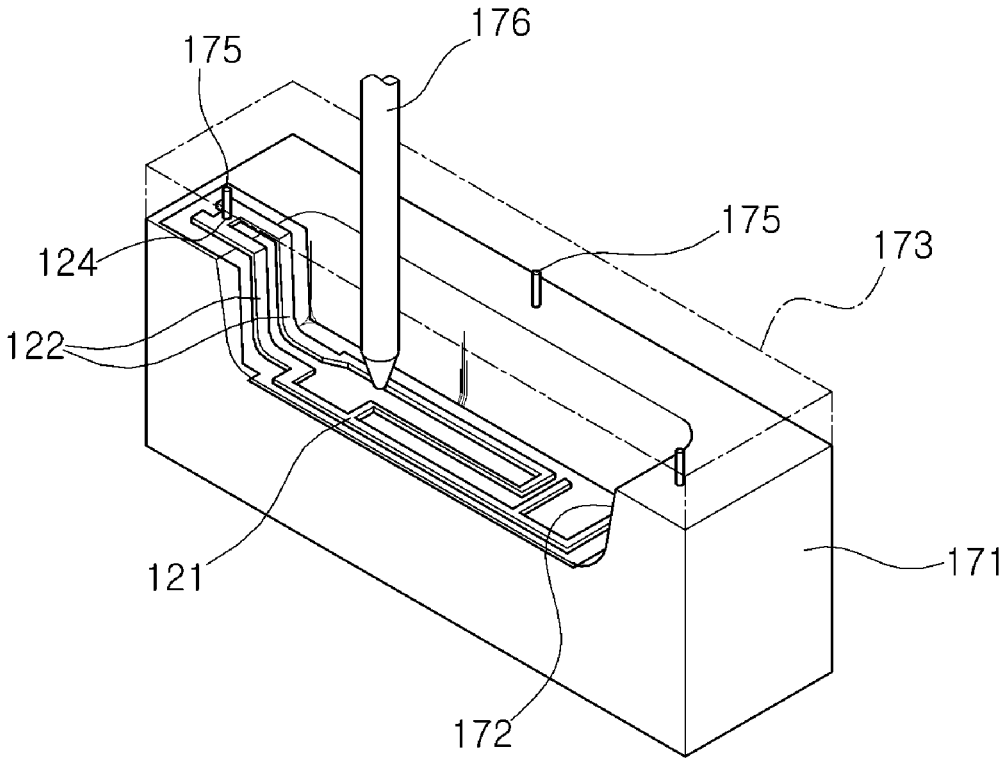

Then, as shown in FIG. 5C, when the lower mold 171 and the upper mold 173 are assembled with each other, each of the position determining pins 175 provided on the lower mold 171 is inserted into each of the position determination holes of the upper mold 173, and a protrusion 174 protruding from the lower surface of the upper mold 173 is inserted into the lower cavity 172 of the lower mold 171.

Here, a lower surface of the protrusion 174 that corresponds to the radiation unit 121 is separated from the radiation unit 121 of the radiator 120 disposed in the lower cavity 172 by a predetermined distance, whereas the protection film 123 on which the radiation unit 121 is formed tightly contacts the lower surface of the lower cavity 172.

On the other hand, the outer surface of the protrusion 174 that corresponds to the terminal units 122 tightly contacts the terminal units 122, while the protection film 123 on which the terminal units 122 are formed is separated from an inner side surface of the lower cavity by a predetermined distance.

When the lower mold 171 and the upper mold 173 are assembled with each other, and the radiator 120 is disposed in a cavity C formed therebetween, if a dielectric resin material is injected through an injection hole 176 whose outlet end is disposed in the cavity C, the dielectric resin material fills in the cavity C to thereby form the front case 110*a* having the radiator 120 integrally formed thereon.

When the fixing end 124 formed on the one end of the radiator 120 is caught by the position determining pin 175, the radiator 120 is secured in position. Therefore, even when high-pressure dielectric resin material is injected into the cavity C formed between the upper and lower molds, the initial fixed position of the radiator 120 is not changed.

Figure 5D:
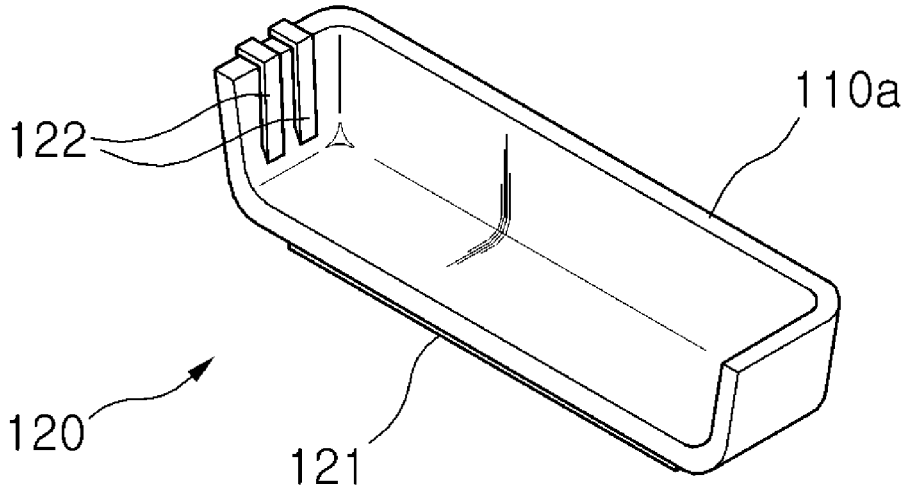

Further, the dielectric resin material injected into the cavity C between the upper and lower molds 173 and 171 is cured after a predetermined period of time. Then, the upper mold 173 and the lower molds 171 are separated from each other. As shown in FIG. 5D, the front case 110*a* is manufactured as follows. That is, the radiation unit 121 tightly contacting the bottom surface of the lower cavity 172 depressed in the lower mold 171 by a predetermined depth is exposed on the outside of the front case 110*a*, whereas the terminal units 122 tightly contacting the protrusion 174 of the upper mold 173 is exposed on the inside of the front case 110*a*. Further, a part connecting the radiation unit 121 and the terminal units 122 are buried in the resin material.

The fixing end 124 of the radiator 120 that protrudes from the front case 110*a* separated from the upper and lower molds 173 and 171 is cut off.

When a board 140 having contact pins 130 on the upper surface thereof is disposed adjacent to the front case 110*a*, since the contact pins 130 correspond to and elastically contact the terminal units 122 that are exposed on the inside of the front case 110*a*, an RF circuit electrically connected to the contact pins 130 form one circuit together with the radiator 120.

Further, since the radiation unit 121 that is exposed on the outside of the front case 110*a* is exposed to the outside through a protection film 123, it is possible to prevent short circuit or damage to the radiation unit 121 caused by the environment.

As set forth above, according to the exemplary embodiments of the invention, the radiation unit is exposed on the outside of the case unit, the terminal units are exposed on the inside of the case unit, and the part connecting the radiation unit and the terminal units is buried in the case unit, such that the radiator is integrally formed with the case unit. Further, the board having the contact pins thereon is disposed adjacent to the case unit, and the contact pins and the terminal units make contact with each other, thereby forming one circuit. Therefore, there is no need to provide the radiator in the separate base and then assembling the base having the radiator thereon with the board like the related art. Accordingly, the number of components is reduced and an assembly process is simplified to thereby reduce manufacturing costs and improve assembly workability.

Further, design flexibility of the radiator provided in the case unit having a large surface area is increased to significantly improve radiation characteristics of the antenna.

While the present invention has been shown and described in connection with the exemplary embodiments, it will be apparent to those skilled in the art that modifications and variations can be made without departing from the spirit and scope of the invention as defined by the appended claims.

What is claimed is:

1. A method of manufacturing an antenna integrally formed with a case, the method comprising:

providing a radiator;

fixing a fixing end of the radiator to a lower mold and disposing the radiator in a lower cavity of the lower mold;

injecting a dielectric resin material into a cavity formed by assembling the lower mold and an upper mold with each other, and molding a case unit having the radiator integrally provided thereon; and separating the upper and lower molds from the case unit and cutting off the fixing end protruding outward from the case unit, wherein in the molding, a radiation unit of the radiator tightly contacts an outer surface of the case unit and is exposed on an outside of the case unit, each of a plurality of terminal units extending from one end portion of the radiation unit is exposed on an inside of the case unit, and a part connecting the radiation unit and the terminal units is buried in the case unit.

2. The method of claim 1, wherein the providing comprises forming conductive patterns on a protection film to form the radiation unit and the terminal units.

3. The method of claim 2, wherein the radiation unit is exposed to the outside through the protection film.

4. The method of claim 1, wherein the fixing comprises fixing the fixing end of the radiator to any one of a plurality of position determining pins provided on the lower mold.

5. The method of claim 4, wherein the fixing end has a fixing hole into which the position determination pin is inserted.

6. The method of claim 1, wherein the case unit includes a front case and a rear case, and the method further comprises disposing the front case having the radiator integrally molded thereon to be adjacent to a board to contact contact pins provided on the board with the terminal units of the radiator.

7. The method of claim 6, wherein the contact pins elastically contact the corresponding terminal units.

8. A method of manufacturing an antenna integrally formed with a case, the method comprising:

providing a radiator;

fixing a fixing end of the radiator to a lower mold and disposing the radiator in a lower cavity of the lower mold;

injecting a dielectric resin material into a cavity formed by assembling the lower mold and an upper mold with each other, and molding a case unit having the radiator integrally provided thereon; and separating the upper and lower molds from the case unit and cutting off the fixing end protruding outward from the case unit, wherein the fixing comprises fixing the fixing end of the radiator to any one of a plurality of position determining pins provided on the lower mold.

9. The method of claim 8, wherein the fixing end has a fixing hole into which the position determination pin is inserted.

10. The method of claim 8, wherein the case unit includes a front case and a rear case, and the method further comprises disposing the front case having the radiator integrally molded thereon to be adjacent to a board to contact contact pins provided on the board with terminal units of the radiator.

11. The method of claim 10, wherein the contact pins elastically contact the corresponding terminal units.

* * * * *